US008974328B1

(12) United States Patent
Sullivan

(10) Patent No.: US 8,974,328 B1
(45) Date of Patent: Mar. 10, 2015

(54) TUNABLE BROADHEAD WITH LOCKABLE BLADE ASSEMBLY FROM SHAFT EXTENDING FROM BROADHEAD TIP

(71) Applicant: Kevin M. Sullivan, Lakemont, GA (US)

(72) Inventor: Kevin M. Sullivan, Lakemont, GA (US)

( * ) Notice: Subject to any disclaimer, the term of this patent is extended or adjusted under 35 U.S.C. 154(b) by 0 days.

(21) Appl. No.: 14/092,196

(22) Filed: Nov. 27, 2013

Related U.S. Application Data

(60) Provisional application No. 61/731,249, filed on Nov. 29, 2012.

(51) Int. Cl.
*F42B 6/08* (2006.01)

(52) U.S. Cl.
CPC ..... *F42B 6/08* (2013.01)
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 5,482,294 | A * | 1/1996 | Sullivan et al. | 473/584 |
| 6,283,880 | B1 * | 9/2001 | Barrie | 473/584 |
| 6,540,628 | B1 * | 4/2003 | Musacchia, Jr. | 473/583 |
| 7,232,390 | B2 * | 6/2007 | Mizek et al. | 473/583 |
| 7,883,435 | B2 * | 2/2011 | Sullivan | 473/583 |
| 2009/0124439 | A1 * | 5/2009 | Sullivan | 473/584 |

* cited by examiner

*Primary Examiner* — John Ricci
(74) *Attorney, Agent, or Firm* — Akerman LLP; Michael K. Dixon

(57) ABSTRACT

A tunable broadhead for archery is disclosed. The broadhead may be formed from a blade assembly that is secured in place by a tip having an elongated engaging shaft that extends through the blade assembly and is attachable to a support base. The support base is in turn attachable to an arrow. The blade assembly may be rotated into any position before the tip is tightened such that the blade assembly is placed under compression between the tip and the support base. Once the tip has been tightened, the blade assembly does not rotate. Such a configuration enables the blades of the broadhead to be indexed relative to the fletching on the arrow and enables the blades to be oriented consistently between multiple arrows in an archer's quiver, thereby enhancing accuracy regardless of the position of the insert within the end of an arrow to which the broadhead is attached.

20 Claims, 2 Drawing Sheets

TUNABLE BROADHEAD WITH LOCKABLE BLADE ASSEMBLY FROM SHAFT EXTENDING FROM BROADHEAD TIP

CROSS-REFERENCE TO RELATED APPLICATION

This application claims the benefit of U.S. Provisional Patent Application No. 61/731,249, filed Nov. 29, 2012, the entirety of which is incorporated herein.

FIELD OF THE INVENTION

This invention is directed generally to broadheads attachable to archery arrows used for hunting, and more particularly to tunable broadheads having features enabling the broadheads to be tuned relative to the arrows to which the broadheads are attached to enhance the flight characteristics of the broadheads.

BACKGROUND

Modern broadheads are tips attachable to a distal end of an arrow shaft and include one or more blades having cutting arrises. The blades extend outwardly from a generally cylindrical broadhead body. The blades typically extend from the broadhead such that the cutting arris of each blade are at an acute angle relative to a longitudinal axis of the broadhead body and extend from a distal point at an intersection at an outer surface of the broadhead body to near the tip at an outer surface of the broadhead body to a proximal point radially outward of the outer surface of the broadhead body. In this position, the blades are capable of cutting flesh as the broadhead passes through an animal.

Modern compound bows can propel arrows at speeds of greater than 300 feet per second. Accurate arrow flight at such speeds is typically only accomplished when all components of the bow and arrow system are tuned properly. For instance, cam timing, cam and wheel alignment, rest position, arrow nock position, fletching clearance, arrow weight consistency, arrow spline consistency, broadhead configuration, and broadhead alignment are all factors that can each greatly affect accuracy. Broadheads have always proved challenging to tune. A longitudinal axis of a broadhead must be aligned with a longitudinal axis of the arrow shaft. Otherwise, the blades can act as airfoils and cause the arrows to plane, which severely affects accuracy.

Broadheads often need to be aligned relative to the arrow shaft to insure adequate clearance of the broadhead past the arrow shelf of a bow. In addition, the blades of a broadhead often need to be aligned with the fletching of an arrow and relative to the bow riser. In particular, in connection with broadheads having two bladed designs, it is often desirable to align the blades of the broadhead such that the blades are generally aligned with the riser of the bow. Sometimes, the blades may need to be aligned differently to create the most consistent arrow flight, which is often determined through repeated use.

Broadheads are commonly attached to arrows through use of a threaded insert glued into the end of a hollow aluminum or carbon arrow. Broadheads typically include a threaded post sized to be inserted into the insert and tightened down with a broadhead wrench. Once the broadhead is tightened into position, the alignment of the blades of the broadhead is examined. The alignment of the blades may be changed in aluminum arrows by heating the insert to loosen or melt the glue so that the insert may be rotated within the aluminum shaft.

Carbon arrows may not be heated because the heat can easily damage the carbon fibers. While heating the arrows enables the inserts to be rotatable within the arrow shaft, repeated heating typically reduces the strength of the glues and often creates poor connections between the inserts and the arrows.

SUMMARY OF THE INVENTION

This invention relates to a tunable broadhead with a lockable blade assembly capable of being indexed relative to an arrow to which it may be attached for archery hunting. In at least one embodiment, the lockable blade assembly enables one or more blades extending from the lockable blade assembly to be circumferentially positioned relative to a support base attached to an arrow. The broadhead may be formed from a blade assembly that is secured in place by a tip having an elongated engaging shaft that extends through the blade assembly and is attachable to the support base. The support base may in turn be attachable to an arrow. The blade assembly may be rotated into any position before the tip is tightened such that the blade assembly is placed under compression between the tip and the support base. Once the tip has been tightened, the blade assembly does not rotate. Such a configuration enables the blades of the broadhead to be indexed relative to the fletching on the arrow and enables the blades to be oriented consistently between multiple arrows in an archer's quiver, thereby enhancing accuracy regardless of the position of the insert within the arrow tip to which the broadhead is attached.

In at least one embodiment, a broadhead for an archery hunting arrow may include a tip configured to facilitate penetration of the blade into an object. The tip may include a pointed distal end and an elongated engaging shaft extending from a proximal end of the tip. The elongated engaging shaft may extend from the tip and may include a tip connection assembly at a proximal end of the elongated engaging shaft. The broadhead may include a hollow blade support body with at least one blade extending radially outward therefrom, wherein the blade assembly has a central shaft receiving chamber extending therethrough. The broadhead may also include a support base configured to engage a proximal end of the blade assembly. The support base may include a distal support base connection assembly on a distal end that is configured to be attached to the elongated engaging shaft and may have a proximal support base connection assembly on a proximal end of the support base that is configured to be attached to an end of an arrow. The blade assembly may be secured between the tip and the support base with the elongated engaging shaft positioned within the central shaft receiving chamber and engaging the support base. The blade assembly may be rotated about the elongated shaft such that orientation of the blade may be changed to extend from any position circumferentially about the blade assembly.

An advantage of this invention is that the blades may be oriented in any position independent of the orientation of the insert within an end of the arrow shaft. Thus, the blades may be oriented in any positioned about a longitudinal axis of the arrow shaft to improve clearance and accuracy. For instance, the blades of three blade embodiments may be aligned with the fletching on the arrow. In other embodiments, such as two blade embodiments, the blades may be aligned to reduce planing upon the broadhead leaving the bow during the initial moments of the shot.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figures 1, 2, 3:
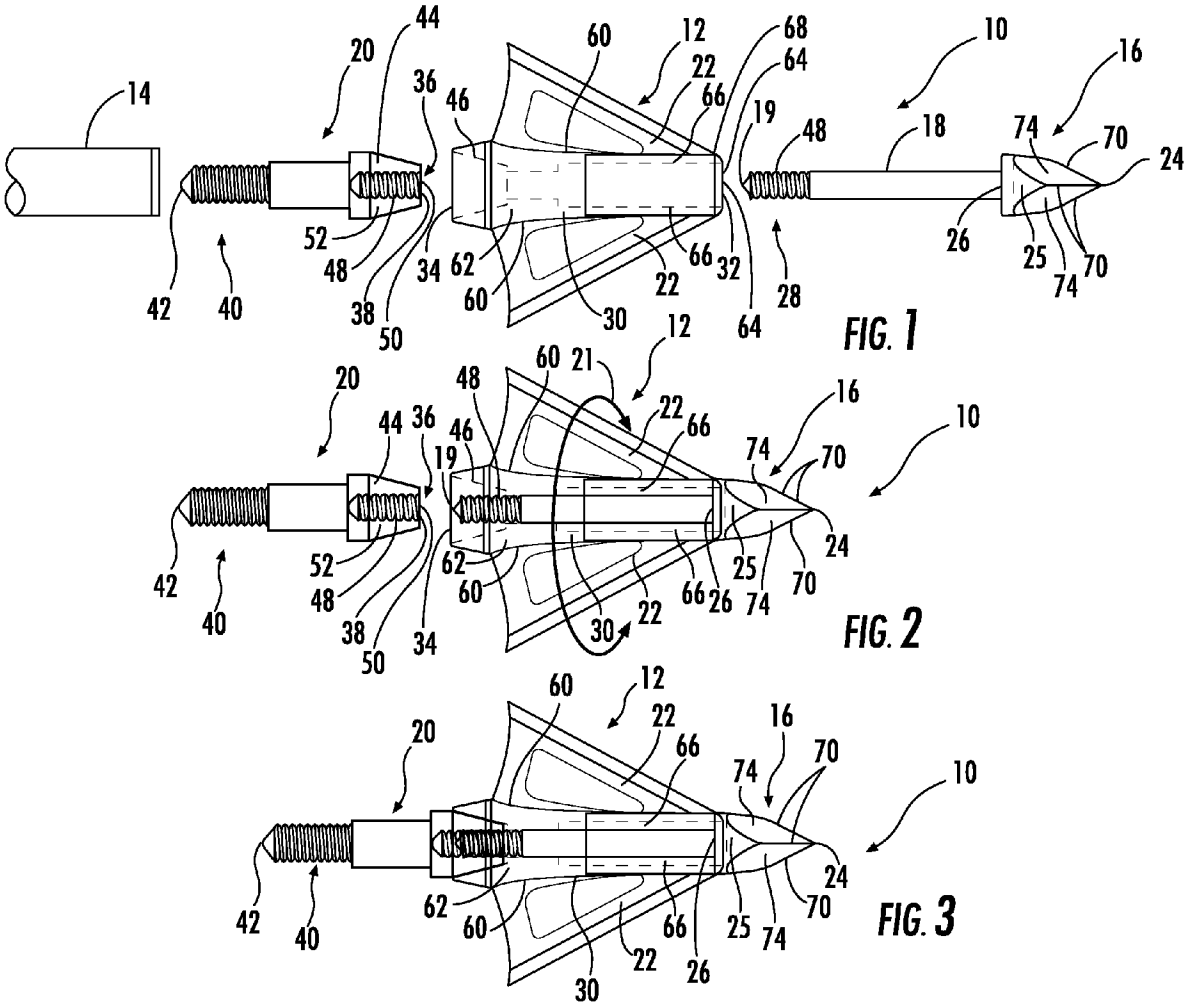
FIG. 1 is an exploded side view of a tunable broadhead of the invention.
FIG. 2 is a partially exploded side view of the broadhead of FIG. 1.
FIG. 3 is an assembled side view of the broadhead of FIG. 1.

As shown in FIGS. 1-4, this invention is directed to a tunable broadhead 10 with a lockable blade assembly 12 capable of being indexed relative to an arrow 14 to which it may be attached for archery. The broadhead 10 may be formed from a blade assembly 12 that is secured in place by a tip 16 having an elongated engaging shaft 18 that extends through the blade assembly 12 and is attachable to a support base 20. The support base 20 may in turn be attachable to an arrow 14. The blade assembly 12 may be rotated into any position, as shown by the arrow 21 in FIG. 2, before the tip 16 is tightened such that the blade assembly 12 is placed under compression between the tip 16 and the support base 20. Once the tip 16 has been tightened, the blade assembly 12 does not rotate. Such a configuration enables the blades 22 of the broadhead 10 to be indexed relative to the fletching on the arrow 14 and enables the blades 22 to be oriented consistently between multiple arrows 14 in an archer's quiver, thereby enhancing accuracy regardless of the position of the insert within the end of an arrow to which the broadhead 10 is attached.

Figure 4:
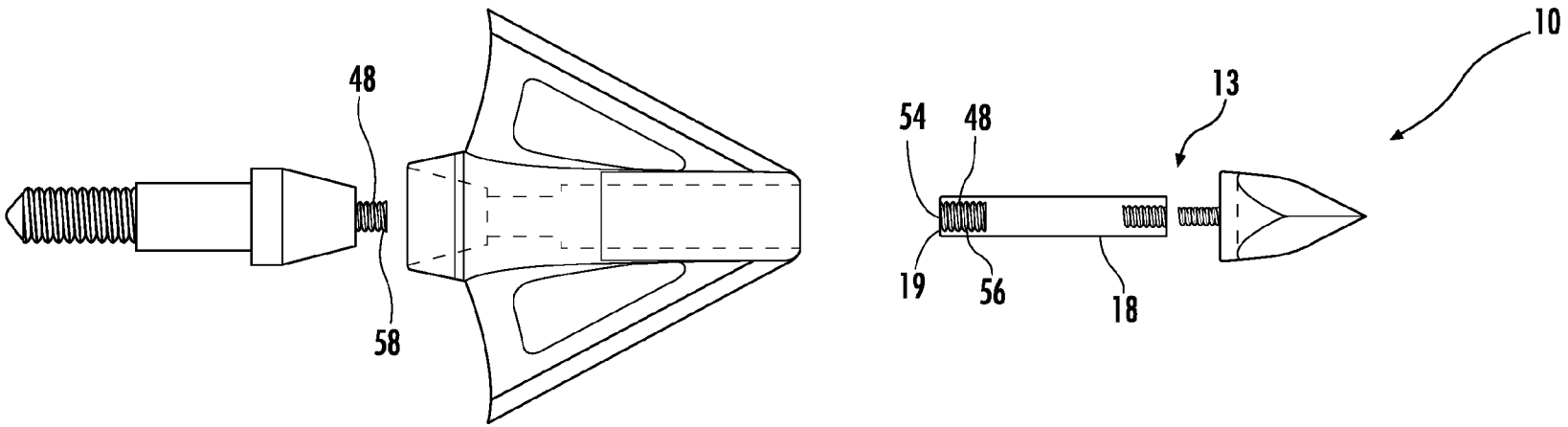
FIG. 4 is an exploded side view of an alternative embodiment of the tunable broadhead shown in FIG. 1.

The broadhead 10 may include a tip 16 configured to facilitate penetration of the blade 22 into an object with a pointed distal end 24 and an elongated engaging shaft 18 extending from a proximal end 26 of a head 25 of the tip 16. The elongated engaging shaft 18 may extend from the tip 16 and may include a tip connection assembly 28 at a proximal end 19 of the elongated engaging shaft 18. A proximal end 19 of the elongated engaging shaft 18 may terminate within the blade assembly 12. The elongated engaging shaft 18 and the tip 16 may be a unitary structure. In another embodiment, the elongated engaging shaft 18 and the tip 16 may be separate components attachable via connection system 13, such as, but not limited to, a threaded connection, as shown in FIG. 4. The elongated engaging shaft 18 may include threads to which the tip 16 maybe attached, or vice versa.

The tip 16 may be pointed and include any appropriate configuration facilitating penetration of the tip 16 into a target, such as an animal or other target. The tip 16 may taper from a point to a cylindrical aft section or have another appropriate cross-sectional shape. In one embodiment, as shown in FIGS. 1-3, the tip 16 may include three cutting arrises 70 that extend from the point 24 and are separated by surfaces 74. As such, the tip 16 may be is formed from a trocar having a plurality of cutting arrises 70. The number of cutting arrises 70 may or may not correspond to the number of blades 22. In one embodiment, the pointed tip 16 may not have any cutting arrises 70. In other embodiment, the pointed tip 16 may have one or more cutting arrises 70. The blades 22 may be aligned with the cutting arrises 70. The tip 14 may be generally cylindrical or have another appropriate shaped outer surface.

The broadhead 10 may include a blade assembly 12 formed from a hollow blade support body 30 with at least one blade 22 extending radially outward therefrom. The blade assembly 12 may include a central shaft receiving chamber 32 extending therethrough. The blade assembly 12 may be secured between the tip 16 and the support base 20 by the elongated engaging shaft 18 extending throughout the central shaft receiving chamber 32 and engaging the support base 20. A distal end 64 of the hollow blade support body 30 may include a tapered outer edge 68 that is configured to mate with a proximal surface 26 of the head 25 of the tip 16.

The broadhead 10 may include a support base 20 configured to engage a proximal end 34 of the blade assembly 12. The support base 20 may have a distal support base connection assembly 36 positioned on a distal end 38 that is configured to be attached to the elongated engaging shaft 18. The support base 20 may also include a proximal support base connection assembly 40 on a proximal end 42 of the support base 20 configured to be attached to an end of an arrow 14.

The distal support base connection assembly 36 on the distal end 38 of the support base 20 may have an outer engagement surface 44 configured to engage an inner engagement surface 46 on the blade assembly 12. The outer engagement surface 44 of the support base 20 may have a conical shape. The inner engagement surface 46 on the blade assembly 12 may have a conical shape that forms a conically shaped chamber sized to receive the conically shaped support base 20. The size and slope of the outer engagement surface 44 of the support base 20 may match a size and shape of the inner engagement surface 46 of the blade assembly 12.

The tip connection assembly 28 may be formed from threads 48 extending radially outward from the proximal end 19 of the elongated engaging shaft 18. The distal support base connection assembly 36 on the distal end 38 of the support base 20 may be formed from a cavity 50 having threads 48 extending into a wall 52 forming the cavity 50 at the distal end 38 of the support base 20. The threads 48 in the support base 20 may match the threads 48 on the tip connection assembly 28 by having the same degree, i.e. fine or coarse, and the same thread pitch.

Alternatively, as shown in FIG. 4, the tip connection assembly 28 may be formed from a cavity 54 having threads 48 extending into a wall 56 forming the cavity 54 at the proximal end 19 of the elongated engaging shaft 18. The distal support base connection assembly 26 on the distal end 38 of the support base 20 may be formed from a threaded shaft 58 extending distally from the support base 20. The threads 48 on the support base 20 may match the threads 48 in the tip connection assembly 28 by having the same degree, i.e. fine or coarse, and the same thread pitch.

As shown in FIGS. 1-3, the blade assembly 12 may have any appropriate configuration such that one or more blades 22 extend radially outward from the hollow blade support body 30. The blades 22 may be releaseably or permanently attached to the hollow blade support body 30. The blades 22 may also be separate elements that are attachable to the hollow blade support body 30. In another embodiment, one or more blades 22 may be integrally formed with the hollow blade support body 30. The blade assembly 12 may be formed from one or more blade slots 60 extending between an outer surface 62 of the hollow support body 30 and the central shaft receiving chamber 32 and extending from a distal end 64 of the blade assembly 12 to the proximal end 34 of the blade assembly 12, but not through the proximal end 34. The blade 22 may be positioned in one of the blade slots 60 and may extend radially outwardly from the hollow blade support body 30 such that a securing flange 66 extending from the blade 22 extends into the central shaft receiving chamber 32. The securing flange 66 may be configured as shown in the numerous embodiments disclosed in U.S. Pat. No. 5,482,294, which is incorporated in its entirety by reference herein.

The broadhead 10 may be assembled by inserting the elongated engaging shaft 18 into the central shaft receiving chamber 32 until the head 25 of the tip 16 contacts the distal end 64 of the hollow support body 30 of the blade assembly 12. The tip connection assembly 28 may then engage the distal support base connection assembly 36 positioned on a distal end 38 of the support base 20. In doing so, the inner engagement surface 46 of the blade assembly 12 is brought into contact with the outer engagement surface 44 of the distal support base connection assembly 36. The blade assembly 12 may be rotated about a longitudinal axis extending through the elongated engaging shaft 18 to position the blades 22 as desired. Once in the desired position, in at least one embodiment, the tip 16 and attached elongated engaging shaft 18 may be rotated to thread the tip connection assembly 28 to the distal support base connection assembly 36. Such action causes the tip 16 to press the blade assembly 12 against the support base 20. In one embodiment, the inner engagement surface 46 of the blade assembly 12 is pressed against the outer engagement surface 44 of the distal support base connection assembly 36. As the tip 16 is tightened, the head 25 of the tip 16, together with the support base 20, places the blade assembly 12 in compression and retains the blades 22 in a desired orientation. The support base 20 may be attached to an arrow in any desired manner, such as, but not limited to being, releaseably or permanently attached. The support base 20 may be releaseably attached via a threaded connection with an insert in the arrow or via a releaseably adhesive. The support base 20 may also be attached via permanent or semi-permanent adhesives and the like.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A broadhead for an archery hunting arrow, comprising:

a tip configured to facilitate penetration of the blade into an object, wherein the tip includes a pointed distal end;

an elongated engaging shaft extending from a proximal end of the tip, wherein the elongated engaging shaft extends from the tip and includes a tip connection assembly at a proximal end of the elongated engaging shaft;

a blade assembly comprising a hollow blade support body with at least one blade extending radially outward therefrom, wherein the blade assembly has a central shaft receiving chamber extending therethrough;

a support base configured to engage a proximal end of the blade assembly, wherein the support base has a distal support base connection assembly on a distal end that is configured to be attached to the elongated engaging shaft and has a proximal support base connection assembly on a proximal end of the support base that is configured to be attached to an end of an arrow;

wherein the blade assembly is secured between the tip and the support base with the elongated engaging shaft positioned within the central shaft receiving chamber and engaging the support base; and wherein the blade assembly is rotatable about the elongated shaft such that orientation of the at least one blade is changable to extend from any position circumferentially about the blade assembly.

2. The broadhead of claim 1, wherein the distal support base connection assembly on the distal end of the support base has an outer engagement surface configured to engage an inner engagement surface on the blade assembly.

3. The broadhead of claim 2, wherein the outer engagement surface of the support base has a conical shape.

4. The broadhead of claim 3, wherein the inner engagement surface on the blade assembly has conical shape that forms a conically shaped chamber sized to receive the conically shaped support base.

5. The broadhead of claim 4, wherein a size and slope of the outer engagement surface of the support base matches a size and shape of the inner engagement surface of the blade assembly.

6. The broadhead of claim 1, wherein the tip connection assembly is formed from threads extending radially outward from the proximal end of the elongated engaging shaft.

7. The broadhead of claim 6, wherein the distal support base connection assembly on the distal end of the support base is formed from a cavity having threads extending into a wall forming the cavity at the distal end of the support base, wherein the threads in the support base match the threads on the tip connection assembly.

8. The broadhead of claim 1, wherein the tip connection assembly is formed from a cavity having threads extending into a wall forming the cavity at the proximal end of the elongated engaging shaft.

9. The broadhead of claim 8, wherein the distal support base connection assembly on the distal end of the support base is formed from a threaded shaft extending distally from the support base, wherein the threads on the support base match the threads in the tip connection assembly.

10. The broadhead of claim 1, wherein a proximal end of the elongated engaging shaft terminates within the blade assembly.

11. The broadhead of claim 1, wherein the blade assembly is formed from at least one blade slot extending between an outer surface of the hollow support body and the central shaft receiving chamber and extending from a distal end of the blade assembly to the proximal end of the blade assembly, but not through the proximal end, and wherein the at least one blade is positioned in one of the at least one blade slots and extends outwardly from the hollow blade support body, wherein a securing flange extending from the at least one blade extends into the central shaft receiving chamber.

12. The broadhead of claim 1, wherein a distal end of the hollow blade support body includes a tapered outer edge that is configured to mate with a proximal surface of the tip.

13. The broadhead of claim 1, wherein the tip is formed from a trocar having a plurality of cutting arrises.

14. The broadhead of claim 1, wherein the tip is coupled to the elongated engaging shaft via a connection system.

15. A broadhead for an archery hunting arrow, comprising:

a tip configured to facilitate penetration of the blade into an object, wherein the tip includes a pointed distal end;

an elongated engaging shaft extending from a proximal end of the tip, wherein the elongated engaging shaft extends from the tip and includes a tip connection assembly at a proximal end of the elongated engaging shaft;

a blade assembly comprising a hollow blade support body with at least one blade extending radially outward therefrom, wherein the blade assembly has a central shaft receiving chamber extending therethrough;

a support base configured to engage a proximal end of the blade assembly, wherein the support base has a distal support base connection assembly on a distal end that is configured to be attached to the elongated engaging shaft and has a proximal support base connection assembly on a proximal end of the support base that is configured to be attached to an end of an arrow;

wherein the blade assembly is secured between the tip and the support base with the elongated engaging shaft positioned within the central shaft receiving chamber and engaging the support base;

wherein the blade assembly is rotatable about the elongated shaft such that orientation of the at least one blade is changable to extend from any position circumferentially about the blade assembly;

wherein the distal support base connection assembly on the distal end of the support base has an outer engagement surface configured to engage an inner engagement surface on the blade assembly; and wherein the tip connection assembly is formed from threads extending radially outward from the proximal end of the elongated engaging shaft.

16. The broadhead of claim 15, wherein the outer engagement surface of the support base has a conical shape, and wherein the inner engagement surface on the blade assembly has conical shape that forms a conically shaped chamber sized to receive the conically shaped support base and wherein a size and slope of the outer engagement surface of the support base matches a size and shape of the inner engagement surface of the blade assembly.

17. The broadhead of claim 15, wherein the distal support base connection assembly on the distal end of the support base is formed from a cavity having threads extending into a wall forming the cavity at the distal end of the support base, wherein the threads in the support base match the threads on the tip connection assembly.

18. The broadhead of claim 15, wherein the tip connection assembly is formed from a cavity having threads extending into a wall forming the cavity at the proximal end of the elongated engaging shaft.

19. The broadhead of claim 18, wherein the distal support base connection assembly on the distal end of the support base is formed from a threaded shaft extending distally from the support base, wherein the threads on the support base match the threads in the tip connection assembly.

20. A broadhead for an archery hunting arrow, comprising:

a tip configured to facilitate penetration of the blade into an object, wherein the tip includes a pointed distal end;

an elongated engaging shaft extending from a proximal end of the tip, wherein the elongated engaging shaft extends from the tip and includes a tip connection assembly at a proximal end of the elongated engaging shaft;

a blade assembly comprising a hollow blade support body with at least one blade extending radially outward therefrom, wherein the blade assembly has a central shaft receiving chamber extending therethrough;

a support base configured to engage a proximal end of the blade assembly, wherein the support base has a distal support base connection assembly on a distal end that is configured to be attached to the elongated engaging shaft and has a proximal support base connection assembly on a proximal end of the support base that is configured to be attached to an end of an arrow;

wherein the blade assembly is secured between the tip and the support base with the elongated engaging shaft positioned within the central shaft receiving chamber and engaging the support base;

wherein the blade assembly is rotatable about the elongated shaft such that orientation of the at least one blade is changable to extend from any position circumferentially about the blade assembly;

wherein the distal support base connection assembly on the distal end of the support base has an outer engagement surface configured to engage an inner engagement surface on the blade assembly;

wherein the tip connection assembly is formed from threads extending radially outward from the proximal end of the elongated engaging shaft;

wherein the outer engagement surface of the support base has a conical shape;

wherein the inner engagement surface on the blade assembly has conical shape that forms a conically shaped chamber sized to receive the conically shaped support base;

wherein a size and slope of the outer engagement surface of the support base matches a size and shape of the inner engagement surface of the blade assembly;

wherein the distal support base connection assembly on the distal end of the support base is formed from a cavity having threads extending into a wall forming the cavity at the distal end of the support base; and wherein the threads in the support base match the threads on the tip connection assembly.

* * * * *